US005916319A

United States Patent [19]

Yoshino

[11] Patent Number: 5,916,319

[45] Date of Patent: Jun. 29, 1999

[54] METHOD TO COLD-BEND RESIN-COATED RIBBED STEEL PIPES

[75] Inventor: Shuji Yoshino, Shizuoka, Japan

[73] Assignee: Yazaki Industrial Chemical Co., Ltd., Japan

[21] Appl. No.: 08/588,009

[22] Filed: Jan. 17, 1996

[51] Int. Cl.[6] ..... B21D 7/022

[52] U.S. Cl. ..... 72/166; 72/369; 72/159; 72/170

[58] Field of Search ..... 72/159, 149, 156, 72/166, 170–175, 369, 367.1; 29/897; 138/177, 145

[56] References Cited

U.S. PATENT DOCUMENTS

| | | | |
|---|---|---|---|
| 3,885,412 | 5/1975 | Vance | 72/369 |
| 4,266,417 | 5/1981 | Imamura | 72/171 |

FOREIGN PATENT DOCUMENTS

| | | | |
|---|---|---|---|
| 1167630 | 4/1964 | Germany | 72/369 |
| 3303631 | 8/1984 | Germany | 72/159 |
| 7853 | 1/1994 | Japan | 72/369 |

*Primary Examiner*—Daniel C. Crane
*Attorney, Agent, or Firm*—Rader, Fishman & Grauer; Ronald P. Kananen

[57] ABSTRACT

A resin-coated ribbed steel pipe that is provided with an axially extending rib that is made from the same material as the coating and forms a hold groove is fed forward and bent along with the rotation of a shaping roller that is provided with an accommodating groove having a shape identical to the half of the cross section of the pipe that includes such rib and also has a protruding wheel that inserts itself into the hold groove as the pipe is fed forward, the reaction force created thereby being managed by a device that, possessing a shape identical to the other half of the cross section of the pipe, suppresses the reaction force and yet allows the feeding of the pipe.

4 Claims, 9 Drawing Sheets

METHOD TO COLD-BEND RESIN-COATED RIBBED STEEL PIPES

BACKGROUND OF THE INVENTION

This invention relates to a method for cold-bending, to a desired curvature, resin-coated steel pipes having a rib or ribs, formed of the same material as the coating, which rib or ribs are formed on the outer periphery of such pipes, especially such pipes having a rib or ribs consisting of a pair of parallel projections that form between such projections a hold groove for holding a wire net or a panel. More particularly, this invention relates to curved resin-coated ribbed pipes bent by this method.

Lately, there has been an increasing demand for hand-pushed trolleys having side walls with wire nets as shown in FIG. 9, and for transparent dome-shaped covers for safety, water tightness or for dust tightness. To meet such demand, resin-coated steel pipes having a rib or ribs for holding a wire net or a transparent panel have been developed. Samples of cross-sections of resin-coated steel pipes are shown in FIG. 8 A–D. The resin-coated steel pipe 1A shown in FIG. 8A is a circular thin steel pipe 10 having an outer diameter of 25.7 mm and a thickness of 0.7 mm, with a uniform coating of about 1 mm of thermoplastic resin, such as AAS or ABS resin, and a rib 12 consisting of a parallel pair of radially protruding equal projections 12*a*, 12*a* formed from the same resin as the coating 11. The projections form a hold groove 13 with a width (3 mm) and a depth (11 mm) capable of holding a panel or other such item or device.

The resin-coated steel pipe 1B shown in FIG. 8B has two radially protruding ribs 12 provided on the outer surface of a circular steel pipe 10, one each at diametrically opposite positions, each such rib consisting of two congruent projections 12*a*, 12*a* formed from the same resin as the coating 11 and each forming a hold groove 13 having a depth and a width capable of holding a panel or other such item or device.

The resin-coated steel pipe 1C shown in FIG. 8C has two ribs 12 provided at a right angle on the outer surface of a circular steel pipe 10, each such rib consisting of two radially protruding congruent projections 12*a*, 12*a* formed from the same resin as the coating 11 and each forming a hold groove 13 having a depth and a width capable of holding a panel or other such item or device.

The resin-coated steel pipe 1D shown in FIG. 8D has three ribs 12 each provided at an angular spacing of a right angle on the outer surface of a circular steel pipe 10, each such rib consisting of two radially protruding congruent projections 12*a*, 12*a* formed from the same resin as the coating 11 and each forming a hold groove 13 having a depth and a width capable of holding a panel or other such item or device.

FIG. 9 and 10 show samples of resin-coated ribbed steel pipes of the kind shown in FIGS. 8A–8D bent to a desired curvature. The arched frames 1A on both sides of the hand-pushed trolley shown in FIG. 9 are the same kind of resin-coated ribbed steel pipes 1A shown in FIG. 8A bent in such a manner that the rib 12 protrudes inwardly toward the center of curvature. The arched frames 1A at both ends of the safety cover shown in FIG. 10 are also the same kind of resin-coated ribbed steel pipes 1A shown in FIG. 8A bent, however, in such a manner that the rib pair 12 protrudes laterally at a right angle to the plane of bending, while the arched center frame 1B is the same kind of resin-coated ribbed steel pipe 1B shown in FIG. 8B bent with the two ribs 12 protruding laterally.

It has been possible to bend ordinary steel pipes or resin-coated steel pipes using conventional pipe-bending machines. However, hitherto no technology or machines have been developed to bend to a desired curvature resin-coated pipes having a rib or ribs as described above.

The simple application of a conventional pipe-bending machine is not sufficient to cold-bend a resin-coated ribbed steel pipe to a desired curvature, especially to bend it in such a manner that the ribs protrude inwardly toward the center of curvature (see the arched frames in FIG. 9), because the ribs would be crushed and corrugated by compression due to the bending, thereby deforming the hold groove and making it very difficult to insert the edge of a panel or a wire net for holding.

Moreover even assuming that the resin-coated ribbed pipe is to be bent in such a manner that the ribs protrude laterally or perpendicularly to the plane of bending (see the arched center frame in FIG. 10), the projection outside the neutral plane of bending would still yield to the tension due to bending and incline inwardly, while the inner projection would incline outwardly, also toward the neutral plane, yielding to the compression due to bending, thereby narrowing or completely blocking the hold groove. This problem would also preclude the use of a conventional pipe-bending machine.

Further, it is almost impossible to hot-bend resin-coated ribbed steel pipes to a desired curvature because the resin-coating and ribs would melt long before the temperature necessary to easily bend steel pipes was attained.

It is the primary object of the present invention, therefore, to provide a method to mechanically cold-bend with precision resin-coated ribbed steel pipes and thus to produce such bent, resin-coated ribbed steel pipes.

SUMMARY OF THE INVENTION

The method according to the present invention for cold-bending resin-coated ribbed steel pipes can be used for resin-coated ribbed steel pipes which have one or more ribs each of which consists of a pair of congruent parallel projections, which are made from the same resin as the coating on the outer periphery of the pipes, and which extend uniformly along the pipe axis. Each such pair of projections forms a hold groove having a width and a depth capable of holding a panel or other such item or device. Moreover, the method can be used for resin-coated ribbed steel pipes made by first applying adhesive on the surface of the pipes and then fixing the coating and ribs that are made from such thermo-plastic resin as ABS or AAS.

The method according to the present invention for cold-bending resin-coated ribbed steel pipes can be used according to the following three modes. In the first mode, the method is used to bend pipes in such a manner that the rib protrudes inwardly toward the center of curvature. In the second mode, the pipes are bent with the ribs protruding laterally or perpendicular to the plane of bending. In the third mode, the pipes are bent with ribs protruding both inwardly and laterally, that is, both within the plane of bending and perpendicular to the plane.

The cold-bending method according to first mode is accomplished by advancing a resin-coated pipe with ribs along with the rotation of a shaping roller which is provided with an accommodating groove formed so as to be identical in shape to the half section of pipe that faces the axle of the roller, and which has a protruding wheel that inserts itself into the hold groove of the inwardly protruding rib. The reaction force of the pipe is managed by a means that possesses an accommodating groove with a section shape identical to the other half of the cross section of the pipe which suppresses the reaction force and yet allows the feeding of the pipe. With this method, the outer surfaces of the pair of projections that constitute a rib of a resin-coated ribbed steel pipe are restrained by the surfaces of the accommodating groove of the shaping roller and, at the same time, the inner surfaces are restrained by the protruding wheel of the accommodating groove, and are thereby protected against the compression force and excessive deformation due to bending. The result is a bent condition that retains the original shape and dimensions of the ribs with a high degree of precision.

The cold-bending method according to the second mode is accomplished by inserting a plurality of spring leaves that have a total thickness identical to the width of the hold groove of the rib of the resin-coated ribbed steel pipe into the groove and by advancing the resin-coated ribbed pipe along with the rotation of a shaping roller. The shaping roller is provided with an accommodating groove formed in the roller so as to have the same shape as the half section of the pipe that includes one of the projections constituting the rib which protrudes laterally or parallel to the axle of the roller. The reaction force of the pipe is managed by a means that possesses an accommodating groove with a section shape identical to the other half of the pipe, which suppresses the reaction force and yet allows the feeding of the pipe. This method prevents deformation of the pair of projections forming the groove toward the neutral plane of bending due to tension on one side and due to compression on the other side of the neutral plane because of the spring leaves inserted in the groove. The result is a bent condition that retains the original shape and dimensions of the rib with a high degree of precision. The use of layers of a plurality of spring leaves is advantageous in that adjustment of thickness to the width of the hold groove can be accomplished easily. The spring leaves also bend very easily due to the mutual slide between leaves and they excel in resiliency and reusability.

The cold-bending method according to the third mode is accomplished by inserting a plurality of spring leaves that have a total thickness identical to the width of the hold groove of a resin-coated ribbed steel pipe into the hold groove which protrudes in a direction perpendicular to the plane of bending, and by advancing the resin-coated ribbed pipe along with the rotation of a shaping roller. The shaping roller is provided with an accommodating groove formed so as to have a shape identical to the half section of said pipe that includes one of the projections of the rib and the rib that protrudes inwardly toward the center of curvature. The accommodating groove has a protruding wheel that inserts itself into the hold groove of the inwardly protruding rib. The reaction force of the pipe is managed by a means that possesses an accommodating groove with a section shape identical to the other half of the pipe which suppresses the reaction force and yet allows the feeding of the pipe. Using this method, the outer surfaces of the pair of projections that constitute the rib that protrudes in the direction perpendicular to the axle of the roller are restrained by the surface of the accommodating groove of the shaping roller and, at the same time, the inner surfaces are restrained by the protruding wheel of the accommodating groove, and are thereby protected against the compression force and excessive deformation due to bending. The result is a bent condition that retains the original shape and dimensions of the rib with a high degree of precision. On the other hand, the pair of projections forming the hold groove of the rib that protrudes parallel to the axle of the shaping roller is prevented from deformation toward the neutral plane of bending due to tension on one side and due to compression on the other side of the neutral plane owing to the spring leaves inserted in the groove. The result is a bent condition that retains the original shape and dimensions of the rib with a high degree of precision.

The bending method according to the present invention employs an electric motor or other means to rotate the shaping roller in the direction and at the appropriate revolution speed so as to feed forward a resin-coated ribbed steel pipe in the accommodating groove for bending. To accomplish bending, the resin-coated ribbed steel pipe is first restrained against the accommodating groove of the shaping roller at the point at which the bend is to begin with a restraining means that is attached to the shaping roller. Then as the roller rotates, the resin-coated pipe is fed forward and bent with the curvature of the accommodating groove.

The bending method according to the present invention may also employ an electric motor or other means to rotate the shaping roller in the direction and at the appropriate revolution speed so as to advance the resin-coated ribbed steel pipe in the accommodating groove for bending. The bending is accomplished, in this case, by restraining the resin-coated ribbed steel pipe at the starting point of the bend by a push roller at a radial position corresponding to the desired curvature. Then, as the shaping roller rotates, the resin-coated pipe is fed forward and bent with a curvature determined by the relative positions of the shaping roller and the push roller. It is said that the minimum radius of curvature permissible for a steel pipe having a diameter of 28 mm and a thickness of 0.7–0.8 mm is about 150 mm.

Using the bending method according to the present invention, resin-coated steel pipes that have a rib or ribs made of the same resin as the coating formed on the outer periphery of such pipes and extending uniformly in the direction of the pipe axis, especially a pair of parallel projections or ribs that form a hold groove having a width and a depth capable of holding a panel, are bent in such a manner that the rib or ribs protrude inwardly toward the center of the curvature or protrude at right angles to the plane of bending.

This invention thus makes it possible to bend resin-coated ribbed pipes to a desired curvature without damaging the ribs or the hold grooves, and thereby contributes to the construction of various articles that use resin-coated ribbed steel pipes such as frames for holding wire nets or transparent panels in the hold grooves.

DETAILED DESCRIPTION

Embodiments of the invention are described below with reference to the drawings.

Figure 1:
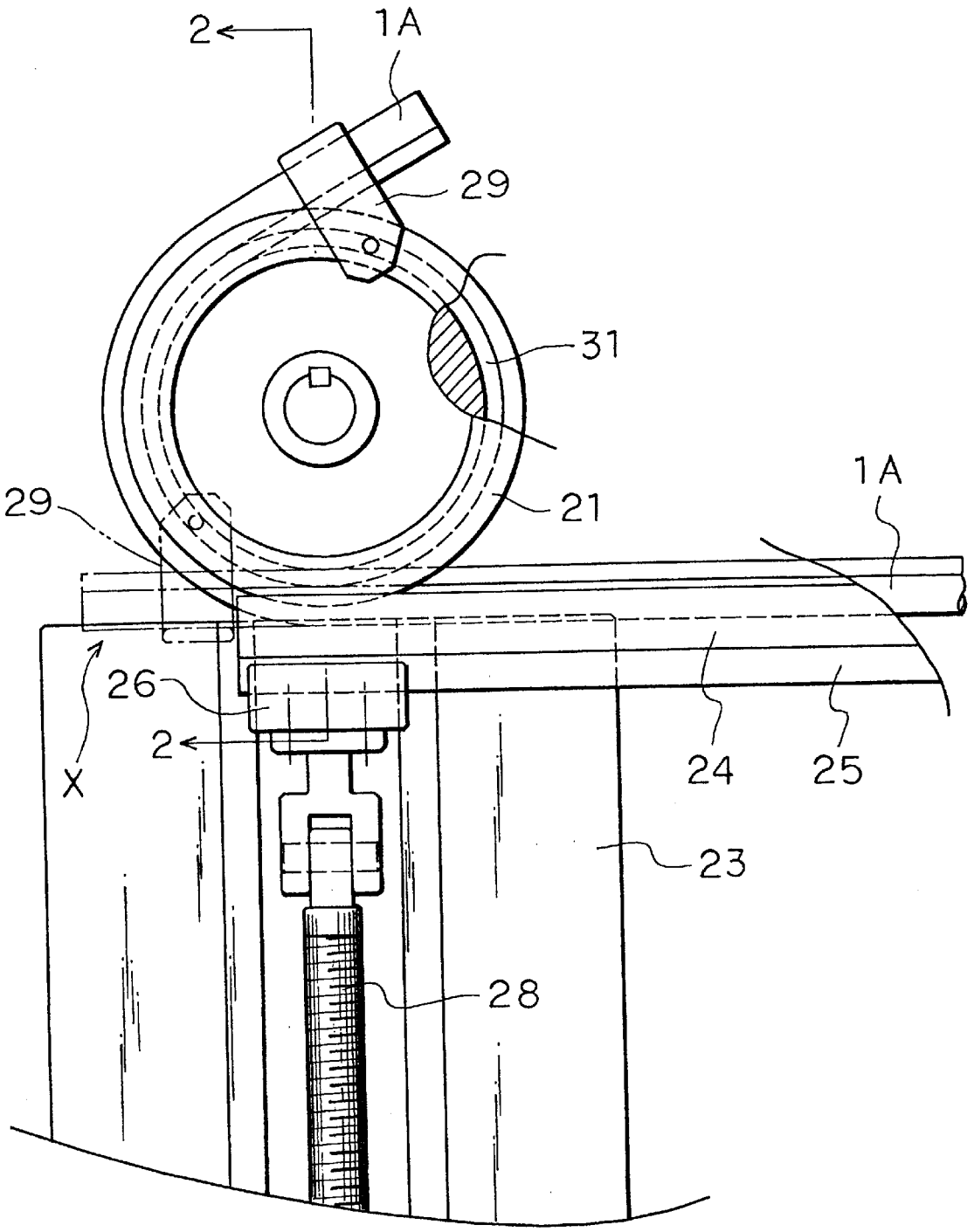
FIG. 1 is an elevational view showing the main aspects of one example of the equipment used in the bending method according to the present invention.
Figure 2:
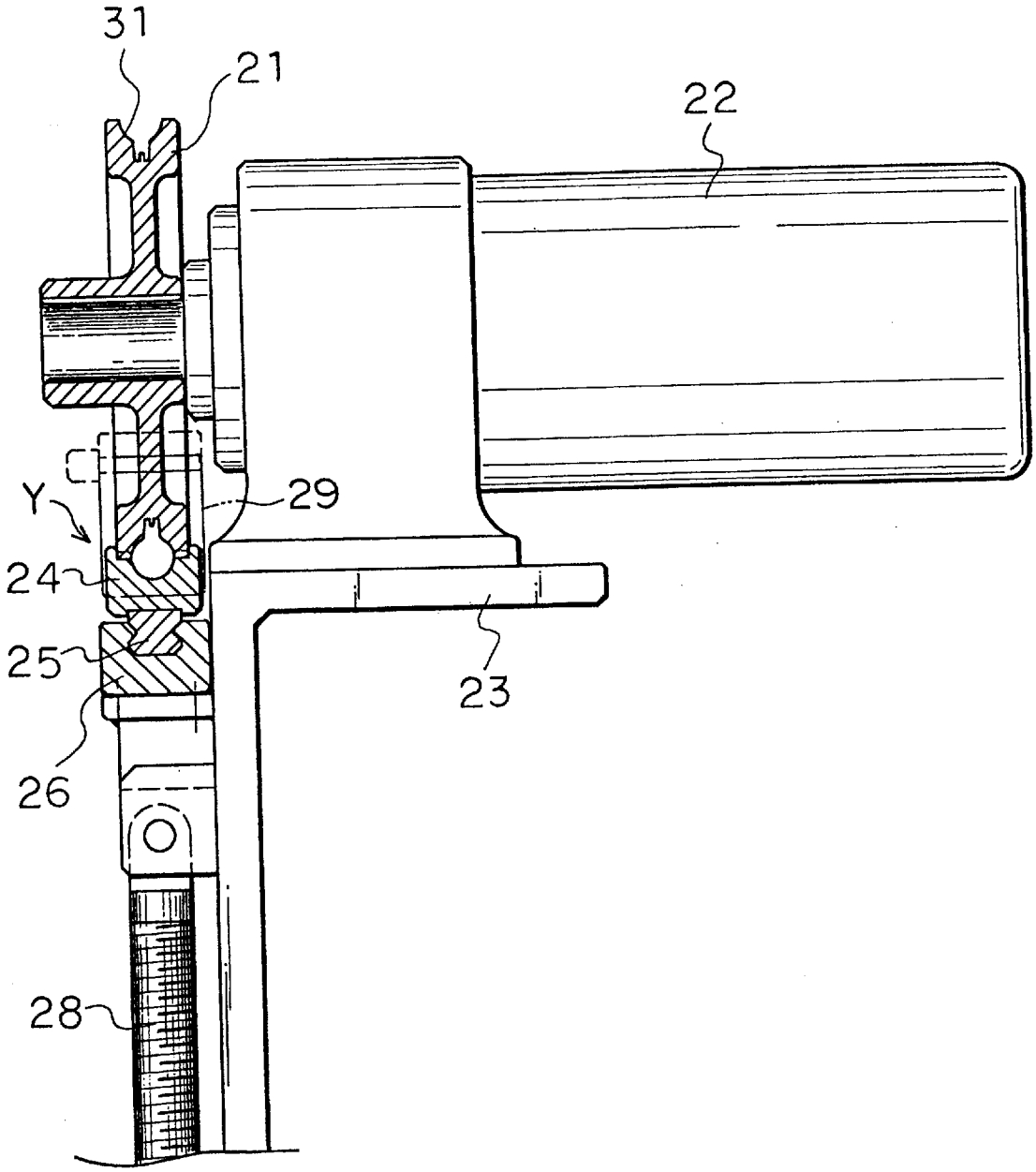
FIG. 2 is a sectional view taken from arrows 2—2 of FIG. 1.
Figure 8A:
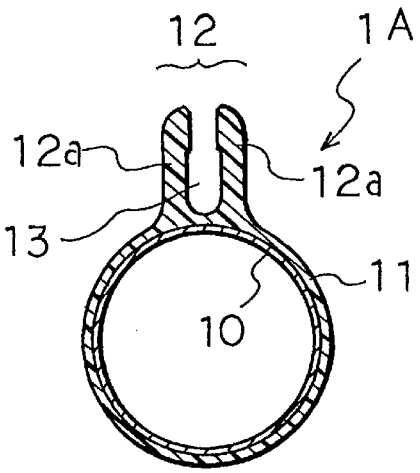
FIGS. 8A–8D are cross-sectional views showing examples of resin-coated ribbed steel pipes.

FIGS. 1 and 2 show an embodiment of the method to cold-bend the types of resin-coated ribbed steel pipes shown in FIG. 8A into arched frames 1A which have a rib that protrudes inwardly toward the center of curvature. A shaping roller 21 is driven by an electric motor 22 equipped with a reduction gear to rotate at a rather slow speed (about 10 m per minute) in the direction of the forward feeding of a steel pipe. The electric motor 22 is fixed on a base frame 23 having the shape of an inverted "L" (see FIG. 2). At a point down the vertical line through the center of the axle of the shaping roller 21 (see FIG. 1), and along the vertical front of the base frame 23, a jack-up device 28 is provided, and one end of a guide rail 25 is horizontally supported by a base 26 that is itself supported so as to be vertically movable on the upper portion of a power shaft of the jack-up device 28. This guide rail 25 has (although not shown clearly in the drawings) approximately the same length as the periphery of the shaping roller 21 and is slidable along the base 26. On the guide rail 25, a pipe-receiving member 24 is firmly supported and moves with the guide rail 25.

Figure 3:
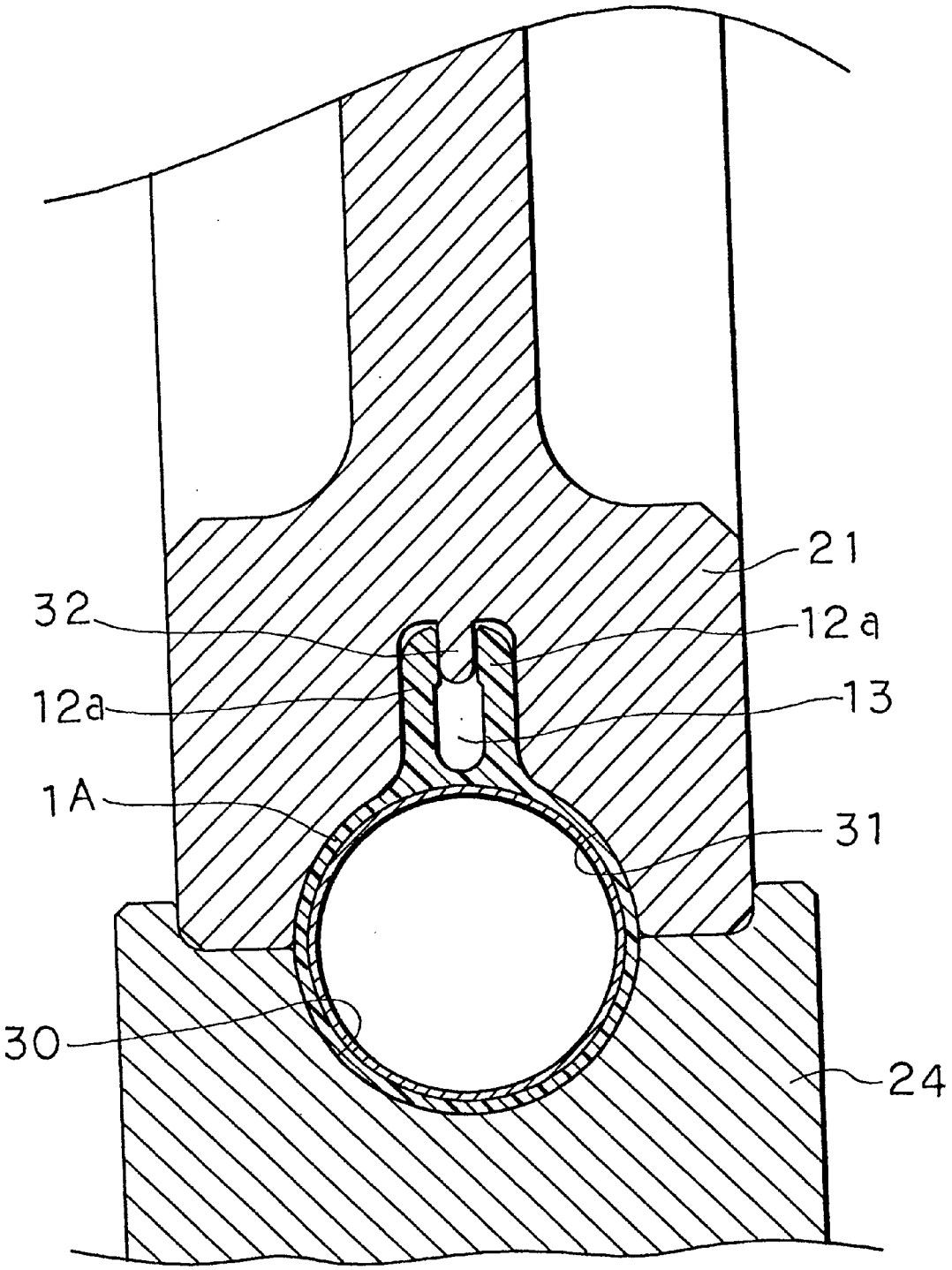
FIG. 3 is an enlarged view of the area designated Y in FIG. 2.

On the shaping roller 21 and the pipe receiving member 24 pipe accommodating grooves are formed which have the shapes shown in FIG. 2 and 3. Namely, on the outer periphery of the rim of the shaping roller 21 an accommodating groove 31 is formed that has the same shape as the half of the cross section of the resin-coated steel pipe 1A that includes the rib 12 which protrudes inwardly, perpendicular to the axle of the shaping roller 21. Moreover, at the center (at the bottom) of the accommodating groove, 31 a protruding flange-like wheel 32 is formed which has a thickness equal to the width of the hold groove 13 formed by projections 12*a*, 12*a* that constitute the rib 12. The protruding wheel 32 is so formed as to insert itself into the hold groove 13. The effective radius of the accommodating groove 31 for the shaping roller 21 should be approximately 300 mm. On the other hand, on the upper surface of the pipe receiving member 24, which is a means to suppress the reaction force from the bending of the pipe, an accommodating groove 30 is formed that has the same shape as the other half of the section of the resin-coated steel pipe 1A (a semi-circle in the case of FIG. 3).

To bend a resin-coated ribbed steel pipe 1A, therefore, the pipe 1A is first set along the accommodating groove 31 of the shaping roller 21 in such a manner that the protruding wheel 32 is inserted into the hold groove 13 of the pipe, while the other side of the pipe is received in the accommodating groove 30. In this setting process, the conditions (especially the grasping force) of the clamping of the resin-coated ribbed steel pipe by the shaping roller 21 and the pipe-receiving member 24 are adjusted appropriately through vertical movement of the base 26 using the jack-up device 28. Then, the portion of the resin-coated ribbed steel pipe 1A that extends from the pipe-receiving member 24, as shown in FIG. 1 by a two-dot chain line and includes the point X where the bending starts, is braced for restraint by a U-shaped restraining means 29. Then as the shaping roller 21 is turned by an electric motor 22, the resin-coated ribbed steel pipe 1A is fed forward and the pipe, together with the rib, is bent with a curvature equal to the accommodating groove 31 of the shaping roller 21. In this process, as the resin-coated ribbed pipe 1A advances, the pipe-receiving member 24 moves on the base 26 with the guide rail 25, thereby allowing the forward movement of the pipe. At the moment the shaping roller 21 has completed the bending to a desired angle of rotation, the electric motor 22 is halted, the restraining means 29 removed, and the pipe is released by lowering the pipe-receiving member 24 along with the base 26 by means of the jack-up device 26, which completes the bending work.

Figure 4:
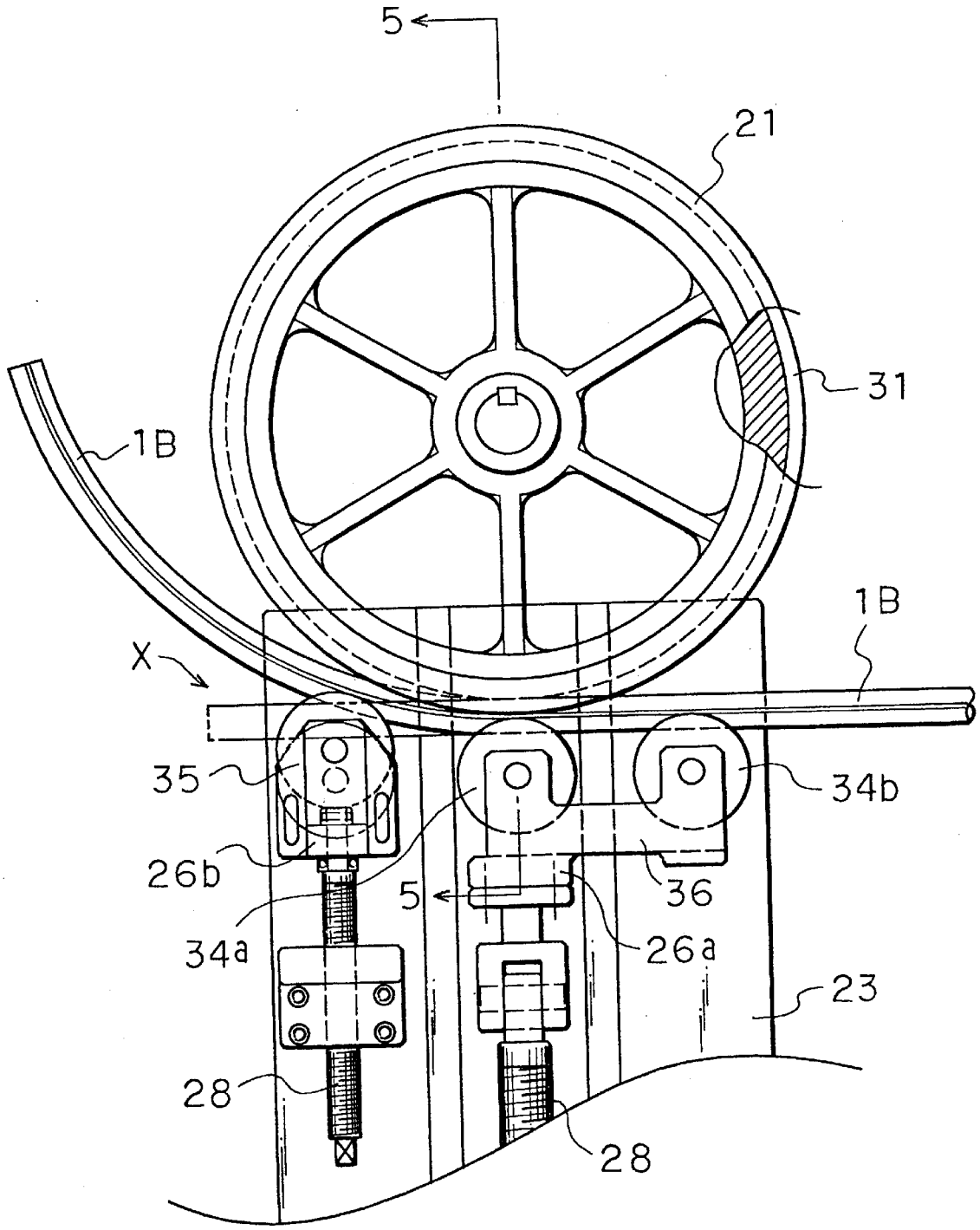
FIG. 4 is an elevational view showing the main aspects of another example of the equipment used in the bending method according to the present invention.
Figure 5:
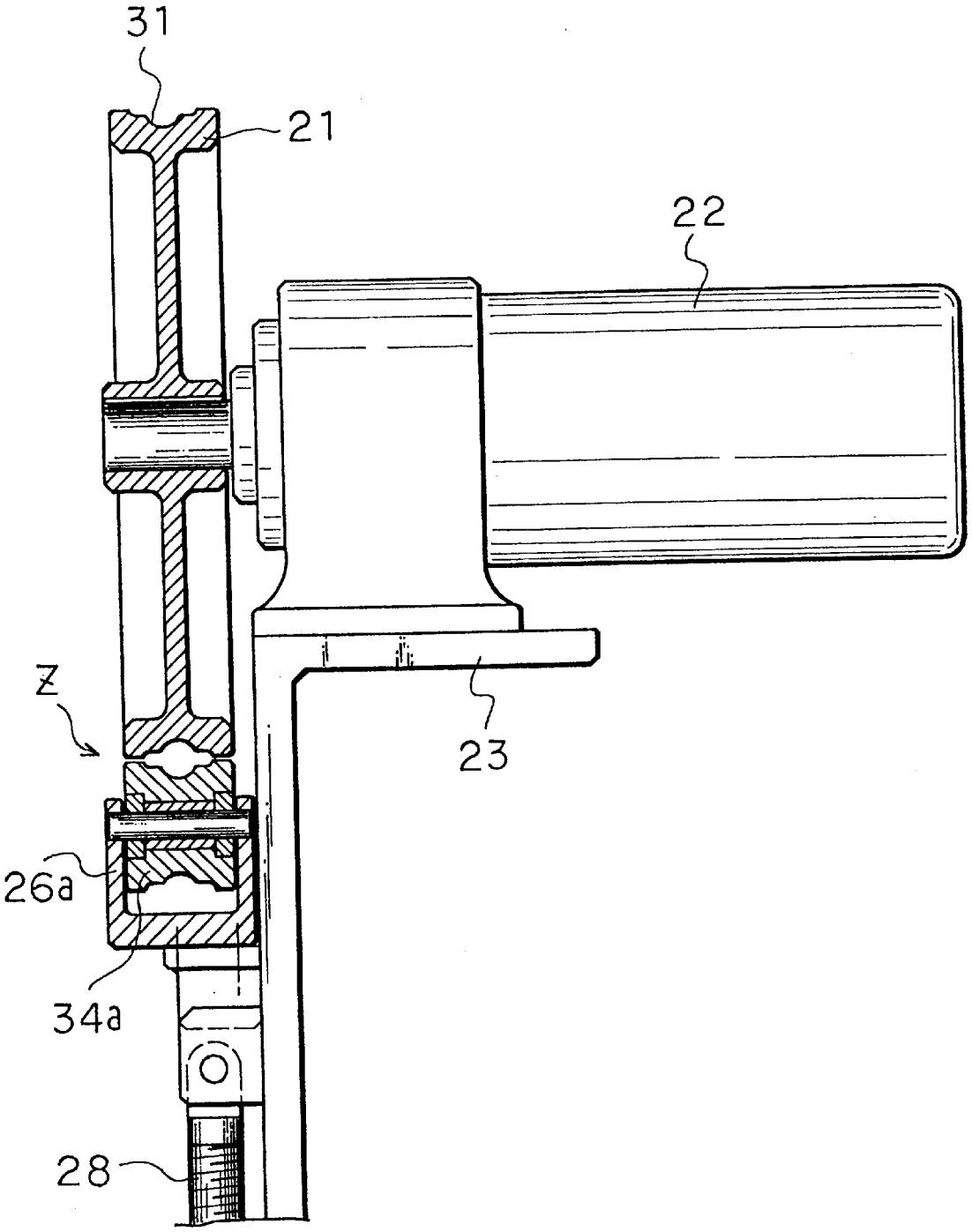
FIG. 5 is a sectional view taken from arrows 5—5 of FIG. 4.
Figure 8C:
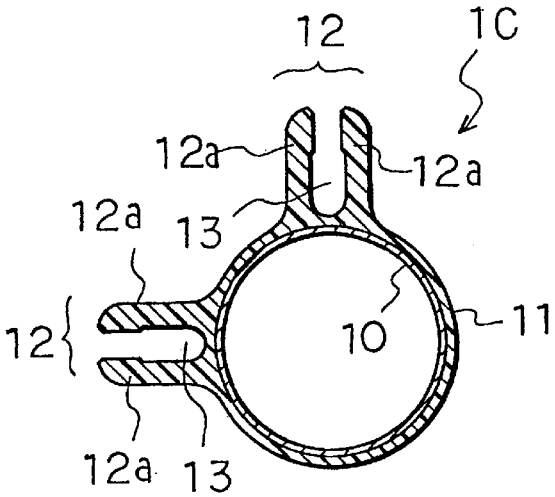
Figure 8B:
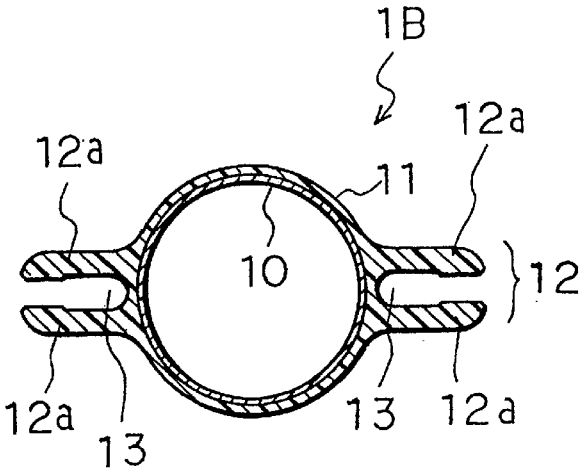
Figure 10:
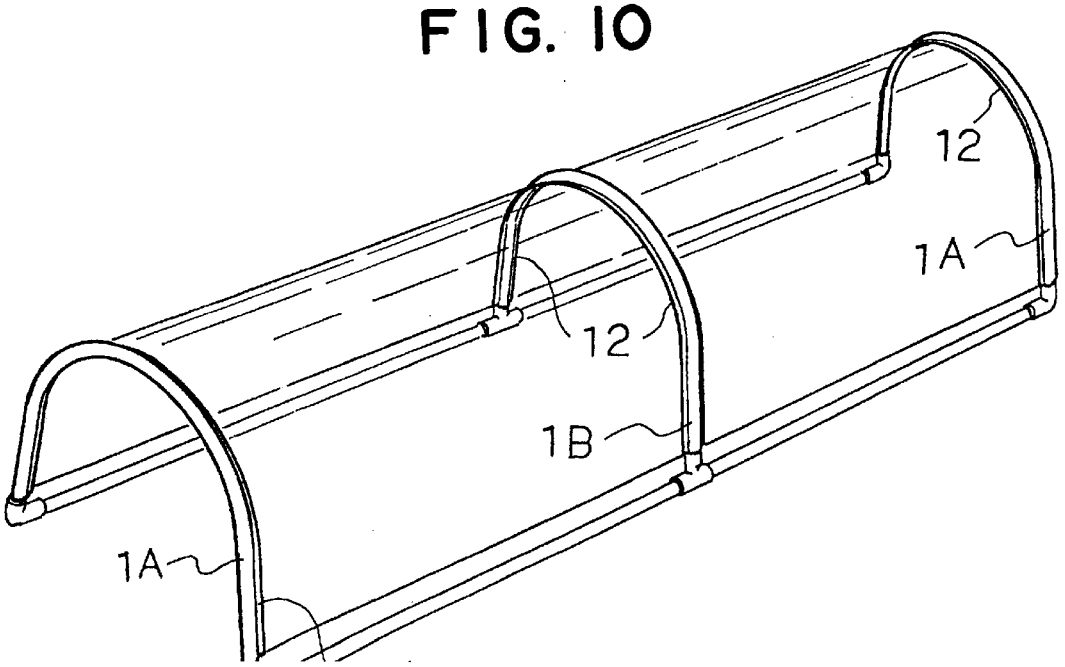
FIG. 10 is a perspective view of a dome-shaped safety cover using bent resin-coated ribbed steel pipes as frames.

Next, FIGS. 4 and 5 show an embodiment of the method to cold-bend a resin-coated ribbed steel pipe with the cross section shown in FIG. 8B, in such a manner that the ribs 12 protrude in the direction perpendicular to the plane of bending, such as the arched center frame 1B shown in FIG. 10. In this case as well the shaping roller 21 is rotated at a low speed by an electric motor 22 equipped with reduction gear. The electric motor 22 is fixed on a base frame 23 having the shape of an inverted "L". At a point along the vertical line through the center of the axle of the shaping roller 21, and along the vertical front of the base frame 23 a jack-up device 28 is provided, and a roller holder 36 that has two (or more) guide rollers 34*a*, 34*b* attached so as to face upward with a spacing along the path of the resin-coated ribbed steel pipe 1B is supported horizontally on a base 26*a* provided at the upper part of said jack-up device 28 and is made movable by means of the jack-up device 28. Further, at a position a little advanced in the direction of feeding of the resin-coated ribbed steel pipe 1B, a push roller 35 that determines the curvature of the bent pipe is supported so as to be vertically movable with a base 26*b* also provided at the upper part of the vertical jack-up device 28.

Figure 6:
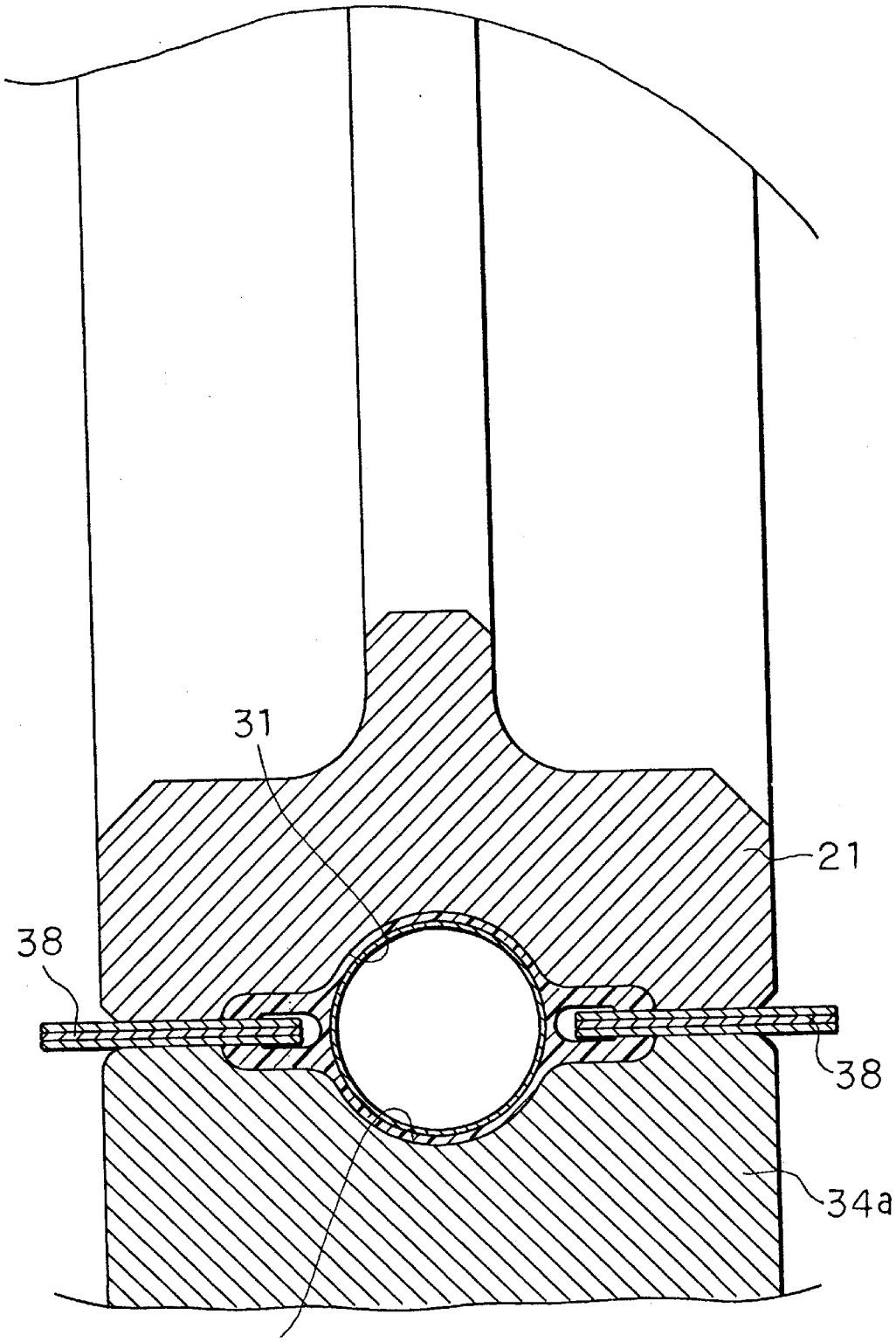
FIG. 6 is an enlarged view of the area designated Z in FIG. 5.

In this embodiment, pipe-accommodating grooves having the shapes shown in FIG. 5 and 6 are formed on the guide rollers 34*a*, 34*b* and push roller 35 that constitute the means to suppress the reaction force of the pipe caused by the bending. On the outer surface of the rim of the shaping roller 21, an accommodating groove 31 is formed that has a shape identical to the contour of one half of the cross section of the resin-coated steel pipe 1B, including one of the projections 12*a* of each rib 12 (a shape consisting of a semi-circle and a recess on either side that has a depth corresponding to the length of the projection 12*a*). On the other hand, on the outer periphery of the guide rollers 34*a*, 34*b* and the push roller 35, an accommodating groove 30 is formed that has a shape identical to the other half of the cross section of the resin-coated steel pipe 1B, including the other projection 12*a* of each rib 12. In this embodiment, the accommodating grooves 31 and 30 are congruent; the guide rollers 34*a*, 34*b* and the push roller 35 are free rollers that rotate along with feeding of the resin-coated ribbed steel pipe.

In this embodiment, at the start of bending of the resin-coated ribbed steel pipe 1B, a plurality of spring leaves 38, that have a total thickness equal to the width of the hold groove 13 of each of the ribs 12, are inserted into the groove 13. The thickness of each spring leaf is about 1 mm. One side of the resin-coated ribbed steel pipe 1B is fitted into the accommodating groove 31 of the shaping roller 21 in such a manner that the ribs 12 protrude in the direction parallel to the axle of the shaping roller 21 and the other side of the pipe is fitted in the accommodating groove 30 of the guide rollers 34*a*, 34*b* and the push roller 35. The clamping pressure of the resin-coated ribbed steel pipe 1B by the guide roller 34*a* and the shaping roller 21 is appropriately adjusted through the vertical movement of the base 26*a* and the roller holder 36 by the jack-up device 28. Further, the portion including the starting point X of the bending of the resin-coated ribbed steel pipe 1B that protrudes to the left of the push roller 35 as shown by a two-dot chain line in FIG. 4 is held by the push roller 35. The push roller 35 is moved by the jack-up device 28 toward the accommodating groove 31 of the shaping roller 21, or, in other words, toward and away from the center of rotation of the shaping roller 21 in the same plane as the accommodating groove 31, and is fixed in a position corresponding to the curvature desired for the steel pipe. After this, the shaping roller 21 is driven by the electric motor 22 and the resin-coated ribbed steel pipe 1B is fed forward with the rotation of the roller 21 and bent to a degree of curvature corresponding to the position of the push roller 35. The radius of curvature in this embodiment is greater than that in the first embodiment.

The embodiment of FIG. 4, 5 can also use a restraining means 29 instead of the push roller 35.

Figure 7A:
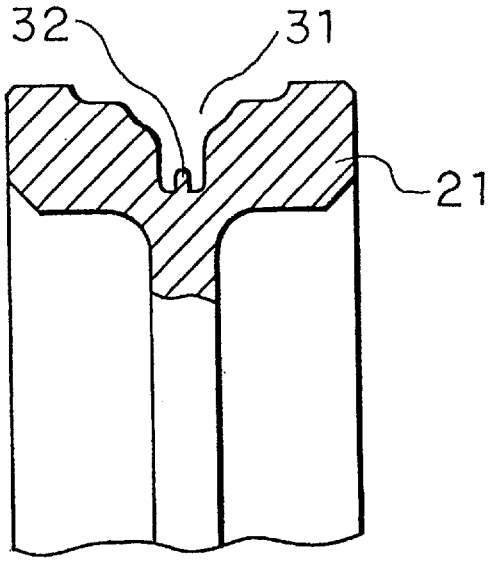
FIGS. 7A–7C are sectional views of different constructions of the accommodating grooves of a shaping roller according to the present invention.
Figure 8D:
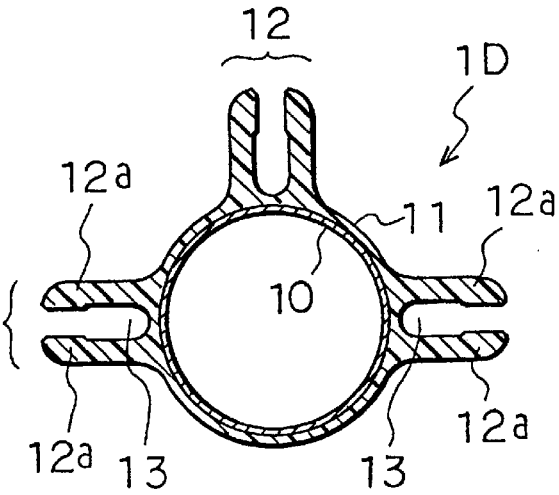
Figure 9:
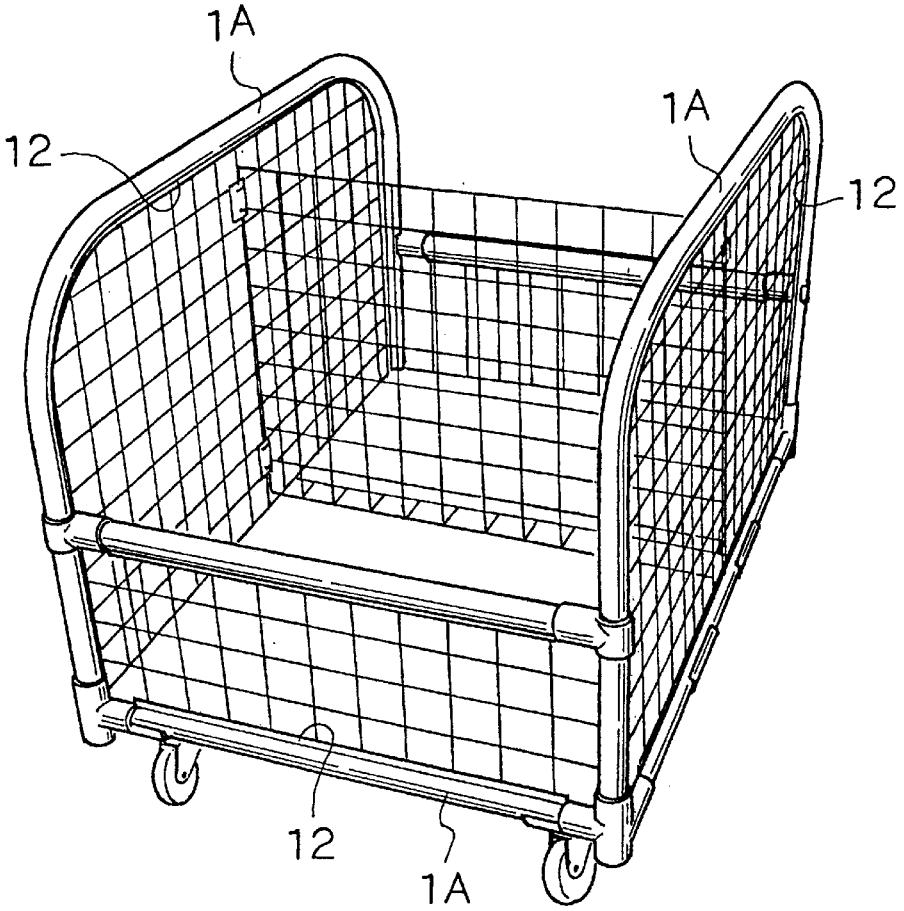
FIG. 9 is a perspective view of a hand-pushed trolley in which bent resin-coated ribbed steel pipes are used as frames.

FIG. 7A shows the section of the accommodating groove 31 of the shaping roller 21 that is used to bend a resin-coated ribbed steel pipe 1D shown in FIG. 8D in such a manner that one of the ribs 12 protrudes inwardly toward the center of curvature while two ribs 12 protrude in directions perpendicular to the plane of bending. In this embodiment as well, a plurality of spring leaves are inserted into the hold grooves of the ribs that protrude perpendicular to the plane of bending, such spring leaves having a total thickness equal to the width of the hold grooves. The accommodating groove 31 of the shaping roller 21 is formed so as to have a shape identical to the half of the cross section of the resin-coated ribbed steel pipe 1D that includes the rib protruding inwardly within the plane of bending and one of the projections of each of the ribs on either side that protrude in directions perpendicular to the plane of bending. Moreover, at the center of the bottom of said accommodating groove, a protruding wheel 32 is formed that inserts itself into the hold groove of the rib that protrudes inwardly. In this embodiment, the method uses either a pipe-accommodating groove described in the first embodiment or guide rollers and a push roller as described in the second embodiment as a means to suppress the reaction force caused by the bending and yet allow for the forward feeding of the pipe.

Figure 7B:
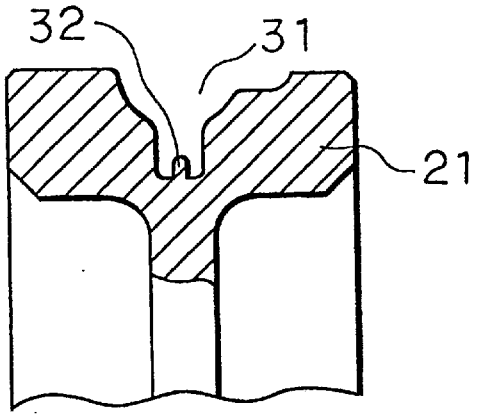

FIG. 7B shows the section of the accommodating groove 31 of the shaping roller 21 that is used to bend the type of resin-coated ribbed steel pipes 1C shown in FIG. 8C in such a manner that one rib 12 protrudes inwardly toward the center of curvature while the other rib 12 protrudes in one direction perpendicular to the plane of bending. The bending process in this case is similar to that for the embodiment relating to FIG. 7A.

Figure 7C:
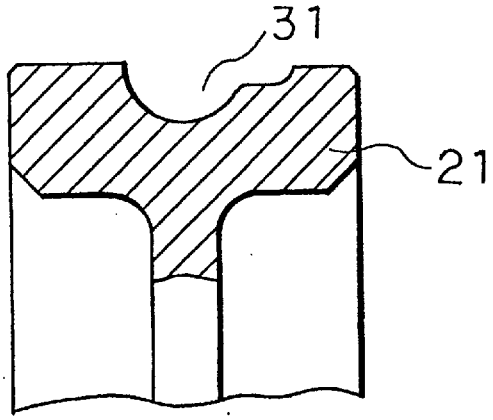

FIG. 7C shows the section of the accommodating groove 31 of the shaping roller 21 used to bend a resin-coated ribbed steel pipe 1A in such a manner that the single rib 12 protrudes in a direction perpendicular to the plane of bending for use in the arched frames such as those for the dome-shaped safety cover shown in FIG. 10. The bending process in this case is similar to that for the embodiment relating to FIG. 7A.

What is claimed is:

1. A method to cold-bend a resin-coated ribbed steel pipe having on an outer periphery thereof a rib or ribs which, made from a same material as said resin coating, consist of a pair of projections that form between each said pair a hold groove having a width and a depth capable of holding a panel or other item and extend uniformly, parallel to an axis of the pipe, in such a manner that each said rib protrudes in a direction perpendicular to a plane of bending, comprising the steps of:

inserting a plurality of spring leaves having a total thickness equal to a width of said hold groove into each of said hold grooves for each said rib;

feeding and bending along a shaping roller provided with an accommodating groove having a shape identical to a half of a cross section of said resin-coated ribbed steel pipe including one of said projections constituting each said rib;

said step of bending along said shaping roller being carried out in such a manner that each said rib protrudes in a direction parallel to an axle of said shaping roller; and managing a reaction force by a means that, possessing an accommodating groove having a shape identical to the other half of said cross section of said resin-coated ribbed steel pipe, suppresses the reaction force and allows feeding of said resin-coated ribbed steel pipe.

2. A method to cold-bend a resin-coated ribbed steel pipe having on an outer periphery thereof ribs, made from a same material as said resin coating, which said ribs consist of pairs of projections that form between each said pair a hold groove having a width and a depth capable of holding a panel or other item and which said ribs extend uniformly, in parallel to an axis of the pipe, in such a manner that one of said ribs protrudes inwardly toward a center of curvature of a bend and the other rib or ribs protrude in a direction perpendicular to a plane of bending, characterized in the method comprising the steps of:

inserting a plurality of spring leaves having a total thickness equal to a width of said hold groove into each of said hold grooves for each said rib that protrudes perpendicular to a plane of bending;

providing a shaping roller with an accommodating groove having a shape identical to a half of the cross section of said resin-coated ribbed steel pipe including said rib that protrudes inwardly to be perpendicular to an axle of said shaping roller and one of said projections of each said rib that protrudes perpendicular to said plane of bending and has a protruding wheel formed in said accommodating groove to insert itself into said hold groove of said inwardly protruding rib;

feeding said resin-coated ribbed steel pipe forward and bending said pipe as said shaping roller rotates with said protruding wheel being inserted into said hold groove of said rib that protrudes inwardly; and managing a reaction force by a means that, possessing an accommodating groove having a shape identical to the other half of the cross section of said resin-coated ribbed steel pipe, suppresses said reaction force and allows feeding of said steel pipe.

3. The method of either of claims 1 or 2 to bend resin-coated ribbed steel pipe by advancing said resin-coated ribbed steel pipe along said accommodating groove of said shaping roller by rotation of said shaping roller, characterized in that said shaping roller is driven to rotate by an electric motor or other means, and that said resin-coated ribbed steel pipe is restrained at a starting point of said bending toward said accommodating groove of said shaping roller by a restraining means attached to said shaping roller.

4. The method of either of claims 1 or 2 to bend resin-coated ribbed steel pipe by advancing said resin-coated ribbed steel pipe along said accommodating groove of said shaping roller by rotation of said shaping roller, characterized in that said shaping roller is driven to rotate by an electric motor or other means, and that a starting point of bending of said resin-coated ribbed steel pipe is restrained by a push roller at a position toward said accommodating groove of said shaping roller corresponding to a desired curvature.

* * * * *